United States Patent [19]

Boeckmann et al.

[11] Patent Number: 4,646,511

[45] Date of Patent: Mar. 3, 1987

[54] TURNING PANEL FLAP OF ZIPPER-EQUIPPED PACKAGE MATERIAL

[75] Inventors: Hugo Boeckmann, Arlington Heights; Peter Lems, Wilmette; Donald L. Van Erden, Wildwood, all of Ill.

[73] Assignee: Signode Corporation, Glenview, Ill.

[21] Appl. No.: 787,113

[22] Filed: Oct. 15, 1985

[51] Int. Cl.[4] ..... B65B 9/06

[52] U.S. Cl. ..... 53/551; 53/568; 53/382; 493/244; 493/410; 493/439

[58] Field of Search ..... 53/382, 492, 568, 551; 493/213, 244, 410, 439, 436, 440

[56] References Cited

U.S. PATENT DOCUMENTS

| | | | |
|---|---|---|---|
| 2,762,273 | 9/1956 | Harker | 493/439 |
| 3,012,603 | 12/1961 | Newsome | 493/440 X |
| 3,274,746 | 9/1966 | James | 53/550 X |
| 3,291,007 | 12/1966 | McDowell | 493/436 X |
| 3,389,532 | 6/1968 | Stelzer | 493/440 X |
| 3,613,524 | 10/1971 | Behr | 493/214 X |
| 4,260,116 | 4/1981 | Collin | 53/568 X |
| 4,449,351 | 5/1984 | Henderson | 53/382 X |

*Primary Examiner*—John Sipos

*Attorney, Agent, or Firm*—Hill, Van Santen, Steadman & Simpson

[57] ABSTRACT

A feed conveyor arrangement is disclosed for horizontally unwinding zipper-equipped sheet packaging material from a supply roll and turning back a flap portion of the sheet material for reception of product prior to delivery into a form, fill, and seal machine. The feed conveyor utilizes a special guide wheel device for maintaining the zipper, and hence the sheet material, in an aligned flow path and holding down the flap portion only adjacent the zipper. A subsequent flap turning wheel device turns the flap portion away from the remaining panel area of the sheet below the zipper line, pivoting the flap about the hold down area of the guide wheel device. The guide wheel device is in the form of skewed wheels acting on the upper surface of the flap at opposed sides of the zipper. The flap turning wheel device includes an offset wheel which applies both upward and horizontal forces to the upturned inner surface of the flap to open up the sheet material.

12 Claims, 6 Drawing Figures

RF
LF
VF

TURNING PANEL FLAP OF ZIPPER-EQUIPPED PACKAGE MATERIAL

BACKGROUND OF THE INVENTION

The present invention relates to a method and apparatus for packaging chunky product or articles, such as cheese, in reclosable zipper-equipped packages and is more particularly concerned with a mechanical arrangement for feeding package wrapper material to a production line in a manner which prepares the wrapper material for reception of product in a unique and expedient manner.

A large volume of products of a relatively chunky, heavy type, such as bulk or sliced cheese food products, have been packaged in horizontal form, fill, and seal machines. The only type of packaging effected by these horizontal form, fill, and seal machines has involved wrapping of flat, plane sheet material about the product and sealing along a longitudinal line and then cross-sealing to complete the package. U.S. Pat. No. 3,274,746 is representative of existing conventional horizontal form, fill, and seal apparatus for packaging relatively heavy articles such as cheese in plastic film or the like. The method there disclosed consists of running the wrapper sheet in the form of a continuous strip along a horizontal packaging line wherein the wrapper sheet is wrapped about the product articles successively placed thereon in spaced units by folding the sheet from opposite sides onto the articles and sealing the opposite longitudinal margins of the sheet together. Finally, the sheet which has, in effect, been sealed into a tubular envelope about the articles, is sealed across the envelope between the articles and separated into sealed individual article-containing package units.

Ser. No. 547,392, filed Oct. 31, 1983 now U.S. Pat. No. 4,589,145, and entitled "Method Of Packaging, Packaging Material Therefor And Package", concerns the use of a zipper-equipped sheet material for producing a package produced on a conventional horizontal form, fill, and seal machine such that the package can be reclosed after access has been gained to the product in the package. The special zipper-equipped material comprises a wrapper sheet having a panel area for engagement with a face of the product, the sheet having portions which extend beyond the panel area and which are adapted to be wrapped into an envelope about the product by folding the sheet portions about the product edges and into engagement with the other face of the product. The free margins of the sheet portions are secured into a seam at the other face of the product and the wrapper sheet is dimensioned to provide for cross-seals at the ends of the envelope. The reclosable zipper means are provided on one of the sehet portions for closing together a web fold on that sheet portion. The web fold is adapted to be severed or ruptured to provide a package mouth opening for access to the product in the envelope, the mouth being reclosable by means of the zipper.

The present invention concerns a novel method and apparatus especially adapted for simultaneously feeding and opening zipper-equipped sheet material to be used for packaging products of a relatively chunky, heavy type, such as bulk or sliced cheese, so as to prepare the sheet material wrapper for reception of product and subsequent wrapping of the product in a form, fill, and seal machine. The inventive apparatus is compact such that the system readily lends itself to converting a conventional from, fill, and seal operation to handle the very different zipper-equipped packaging materials. The inventive apparatus is principally reliable at relatively low speed production rates.

SUMMARY OF THE INVENTION

Zipper-equipped prefabricated wrapper sheet material, such as disclosed in Ser. No. 547,392 is unwound from a roll by means of an inventive feed conveyor arrangement which serves to simultaneously conduct and open up the sheet material for reception of product or delivery to a horizontal form, fill, and seal machine.

The sheet material on the roll is in the form of a relatively large panel area which is overlapped along one edge with a folded back web portion brought back only part way over the top base of the panel area. A reclosable elastically deformable plastic zipper means, in the form of a pair of complementary rib and groove interlockable strips, is correspondingly disposed longitudinally along the inner surface of the web portion and the top face of the panel area adjacent the edge of the panel securing together the web and panel portions of the sheet.

The feed conveyor arrangement, after being initially threaded with a lead portion of the sheet material to be unwound from the roll, conducts the sheet material to the form, fill, and seal machine by means of a plurality of wheel sets. As the sheet material is unwound from the roll, relatively thickened portions of the sheet material defined by the zipper fastener strip pass along a guideway recess formed in a base platform of the feed conveyor arrangement, aligned with the guideway by means of a pair of complementary resiliently disposed wheels which act on opposite sides of the zipper fastener strip along the top surface of the web portion. As the sheet material passes further along the conveyor platform, the web portion flap is lifted off and turned away from the panel area of the sheet material by means of a further guide wheel device in the form of a rotatable platform wheel having an axis of rotation perpendicular to the top face of the base platform and an overlying resiliently mounted flap guide wheel having a lateral axis of rotation disposed at an acute angle from the longitudinal direction of movement of the sheet material to the form, fill, and seal machine. The inner surface of the web portion is turned away from the panel area of the sheet as the web portion is disposed between the upper surface of the platform wheel and an overlying lower edge of the flap guide wheel. Frictional engagement of this wheel with the web portion and underlying platform wheel produces a guide force to the turned away web portion which is the resultant of lateral and longitudinal friction forces.

After the web portion has been turned away from the panel area of the sheet on the feed conveyor arrangement, the sheet wrapper is opened up with the web portion folded back over itself at the longitudinal line formed by the complementary zipper fastener strips and conveyed over a discharge guide roll into the form, fill, and seal machine where product is placed on the panel area. The free edge of the panel area and the free edge of the web portion are folded back over on top of the product to form a longitudinal seam which is sealed over the product. The form, fill, and seal machine then typically heat seals the longitudinal seam and forms transverse side seals across the tubular envelope at opposed ends of the product, which adjacent side seals are separated from one another to form individual article-containing package units.

By virtue of the invention, a reliable and expedient system is provided for unwinding zipper equipped sheet material from a roll and opening up the sheet material for wrapping of a product therein in a horizontal form, fill, and seal machine. Further beneficial features and advantages of the invention will be recognized from the following description and the drawings concerning the preferred embodiment.

DESCRIPTION OF THE PREFERRED EMBODIMENT

Figure 1:
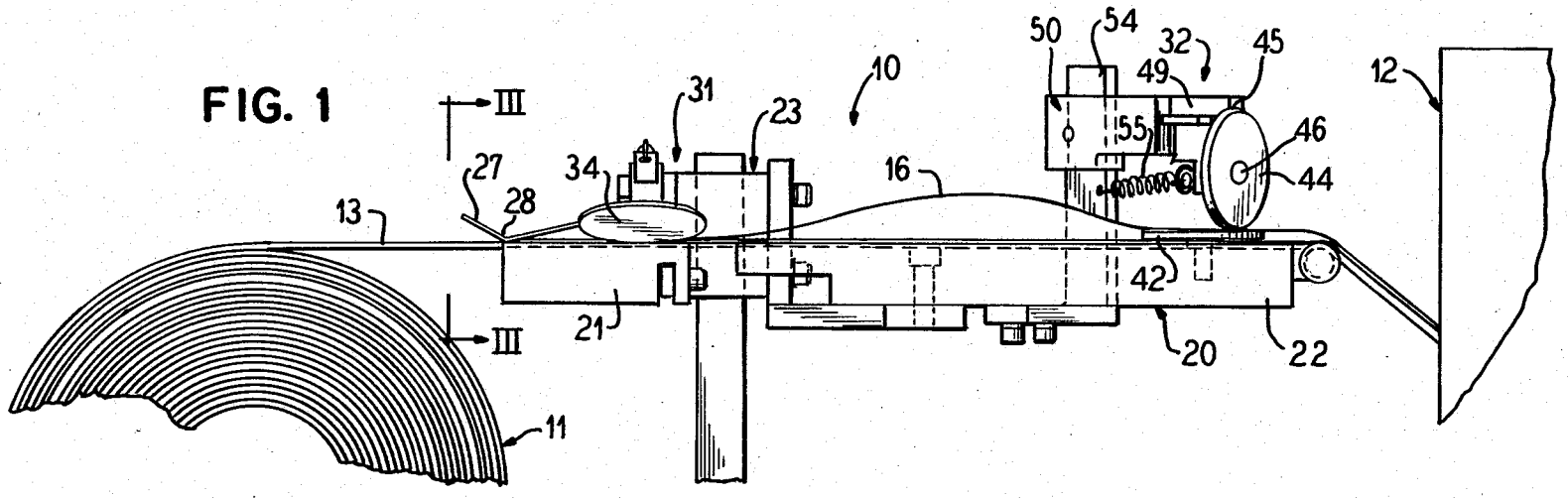
FIG. 1 is a side elevational view of a feed conveyor arrangement constructed in accordance with the present invention.

FIG. 1 illustrates a feed conveyor system 10 constructed in accordance with the present invention for opening zipper equipped sheet material unwound from a roll 11 prior to introduction into a horizontal form, fill, and seal machine 12. The arrangement of FIG. 1 is specifically adapted for use in packaging chunky, heavy type product, such as bulk or sliced cheese, in a continuous wrapper material 13, generally plastic film material, equipped with zipper means so that resulting individual package units are of a type which can be reclosed after access has been gained to the product in the package.

The wrapper material 13 is constructed in a manner disclosed in Ser. No. 547,392. That is, with reference to FIGS. 1 and 2, the wrapper material has a continuous elongate panel area 14 on which the bottom face of the product is to be received. The panel area 14 is of a width such that there is a substantial free end portion 15 which will serve as a flap extending beyond the product reception surface area of the panel 14 provided along the lower edge of the sheet material 13. The upper edge of the sheet material 13 is turned over back onto the top face of the panel area 14 in the form of a web flap portion 16. The web flap 16 and bottom flap 15 portions of the wrapper sheet define free end laminar margins which will form a longitudinal seam seal over the top face of the product. Aligned with one another and extending longitudinally of the sheet material 13 on the top surface of the panel area 14 and inner facing surface of the overlying web flap portion 16 are a pair of complementary extruded plastic multi-rib and groove interlockable strips 17 forming a reclosable elastically deformable plastic zipper fastener of a known type, scuh as disclosed in U.S. Pat. Nos. 3,198,228; 3,780,781; 3,886,633; and 4,372,793.

The form, fill, and seal machine 12 may be of a known construction, such as disclosed in U.S. Pat. No. 3,274,746, such that open continuous sheet wrapper receives substantially intermediately thereof successive individual product articles as the sheet wrapper is advanced along a horizontal production line. The machine serves to fold opposed edges of the wrapper onto the product, bringing the opposed edges convergently together for sealing into a longitudinal seam as by means of a pair of cooperating sealing pinch rolls for producing a heat seal or for adhesively securing together the opposed edges. The thus tubular envelope package is then formed with cross seals at opposed side ends of the package, such as by means of cooperatively, reciprocable heat sealing bars, and adjacent side ends of successive packages are separated, such as by means of a tear line or heat separation, to produce successive individual package units.

The zipper fastener strip 17 of the sheet material is disposed to be outside of the product reception area of the panel portion 14. Thus, as disclosed in Ser. No. 547,392, the resulting package unit from the form, fill, and seal machine 12 is a hermetically sealed package having reclosable zipper fastener profiles extending along one side edge of the package spaced from the contained product. Folded over flap web portion 16 of the sheet material 13 defines a closure web 18 at the fold which is disposed above the complementary zipper locking strips 17 to form a tamper-proof seal to access to the wrapped package. The closure web 18 maintains the sealed integrity of the package until this fold is severed or ruptured to gain access to the zipper means 17 for opening and closing the package, the wrapper sheet portions disposed about the zipper strip 17 defining a mouth opening for access to the product. Further details of the zipper equipped form, fill, and seal machine produced wrapper package are found in Ser. No. 547,392.

Figures 2, 4, 6:
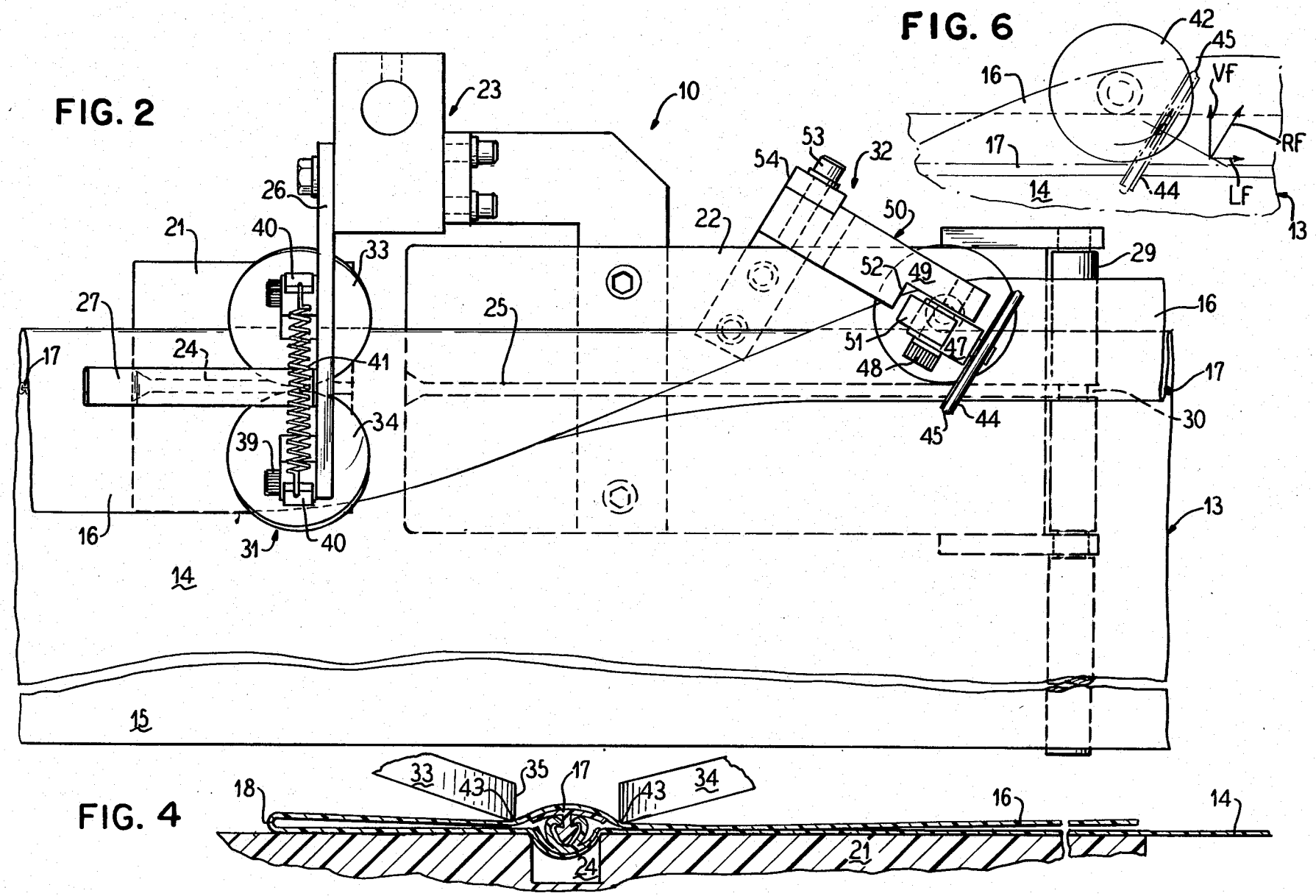
FIG. 2 is a plan view of the feed conveyor arrangement of FIG. 1.
FIG. 4 is a fragmentary cross-sectional view illustrating the action of the complementary guide wheels on the thickened zipper strip portion of the package sheet material as the sheet material is conveyed through the feed conveyor arrangement of FIG. 1.
FIG. 6 is a schematic plan profile view of the web unfolding wheel device of FIG. 5 illustrating the component and resultant guide forces applied to the folded back web portion of the sheet prior to discharge from the feed conveyor arrangement of FIG. 1.

The wrapper material 13 is coiled on the supply roll 11 in its normal production state, that is, as shown entering the feed conveyor system 10 from the left in FIG. 2, with the web flap 16 overlying the panel 14 and the zipper fastener strips 17 interlocked. Of course, the relatively raised thickness portions on the wrapper sheet at the zipper fastener strips 17 will typically not be aligned in the coil layers on the supply roll, such that the sheet material will laterally oscillate as it is unwound from the roll. The feed conveyor system 10 serves to conduct the wrapper material 13 as it is unwound from the roll 11 to the form, fill, and seal machine 12 and to prepare the wrapper material for receiving the product and subsequent wrapping of the product in the machine 12 by turning away the web flap portion 16 from the panel area 14 of the wrapper to clear the area of the panel portion for reception of product. In accordance with the invention, the feed conveyor 10 is initially threaded up with a lead end of the wrapper material 13, the lead end of which is extended to the drive mechanism, which may be in the form of driven seam sealing pinch rolls in the form, fill, and seal machine 12.

The feed conveyor 10 includes a stationary platform means 20, which could be vertically or horizontally directed in a wrapper sheet flowpath, having first and second successive guide table surfaces 21 and 22 over which the wrapper material 13 lies flat enroute to the machine 12. The first and second guide table surfaces 21 and 22 are suitably supported on an upstanding bar and bracket means 23. As shown in FIG. 2, the top faces of the guide table 21 and 22 are each formed with aligned longitudinally extending channel recesses 24 and 25. These channel recesses 24 and 25 serve to receive and guide therealong the lower portion of the relatively thickened areas of the zipper means profile strips 16, such that the wrapper material 13 passes over the top surface of the first and second guide tables 21 and 22 in a flat, planar condition with the zipper strips 17 riding along the channel recesses 24 and 25 and the lower edge flap portion 15 disposed off the surfaces of the tables 21 and 22.

To maintain reliable alignment of the continuous wrapper sheet 13 as it is unwound from the roll 11, there is provided a stationary support arm 26 affixed at one end to the bar and bracket means 23 and having a free end extension extending laterally transverse of the longitudinal direction of movement of the sheet material 13 and overlying the downstream end of the first guide table surface 21. Extending downwardly and then upwardly from the support arm 26 is a resilient upturned spring clip 27 defining an engagement portion 28 biased downwardly directly over the lead in end of the channel recess 24. The folded web flap portion 16 of the sheet material 13 is threaded between the first guide table surface 21 and the engagement portion 28 of the spring clip 27, which assists in assuring the zipper fastener profile strips 17 are interlocked and indeed rightly aligned the channel recess 24. At the downstream end of the second guide table surface 22 there is suitably journaled for free rotation a discharge roller 29 having a first width portion coextensive with the width of the guide table 22 and a free-standing second width portion extending outward from the guide table 22 for supporting the remainder panel area 14 and its flap portion 15 en route to the machine 12. The first width portion of the roller 29 is provided with a circumferential recess area 30 which is aligned with the downstream end of the channel recess 25 to receive the bottom portion of the zipper fastener strip 17 as it leaves the guide table surface 22 to further assist in guiding and aligning the sheet material as it passes to the machine 12.

Intermediately of the spring clip 27 and discharge roller 29 there is provided a special guide wheel device 31 which is disposed adjacent the upstream end of the feed platform 20 and flap turning wheel device 32 which is disposed adjacent the downstream end of the feed platform 20.

Figure 3:
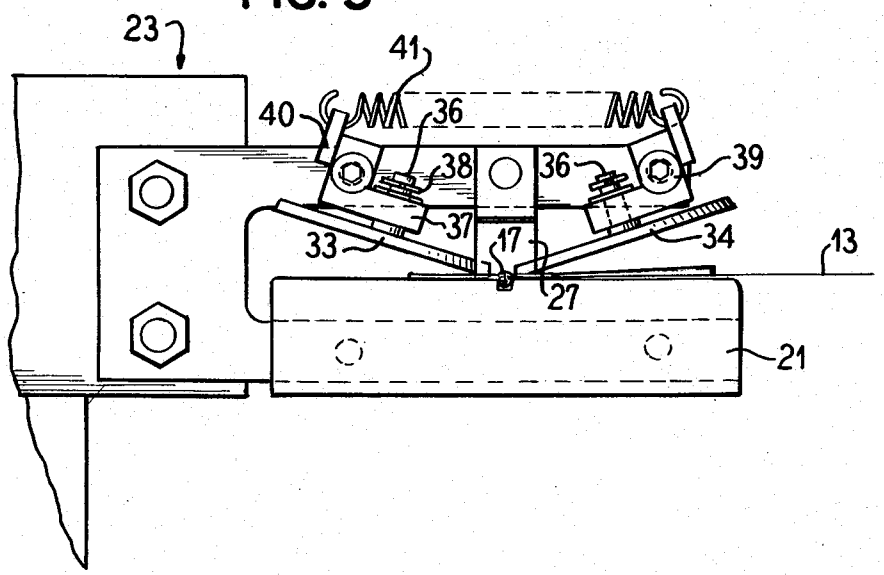
FIG. 3 is a fragmentary end elevational view taken along the lines III—III of FIG. 1.

With reference to FIGS. 2–4, the upstream guide wheel device 31 comprises a pair of skewed rotatable wheels 33 and 34, each of which is formed with a circumferential bevelled side edge 35. The wheels 33 and 34 are disposed for rotation on opposite lateral sides of the zipper-receiving channel recess 24 in the first table surface 21 and the wheels 33 and 34 and their mountings are arranged so as to be complementary of one another, that is they are disposed in mirror-image fashion across a longitudinal separation gap line which is taken up by the thickened portion of the zipper profile strips 17 of the wrapper sheet 13.

The upper surfaces of the wheels 33 and 34 are each provided with a stub shaft 36 which is supported for rotation in a L-shaped journal arm 37 by means of a snap ring key means 38. The upper ends of each journal arm 37 are pinned by means of a shoulder bolt 39 connected to the support arm 26 for pivotable movement about longitudinally directed axes defined by the shoulder bolts. The upper ends of the journal arms 37 respectively supporting the wheels 33 and 34 are provided with upstanding flanges 40 having suitable grip or hole designs for engagement with one end of a coil spring 41 extending between the flanges 40 and serving to bias the journal arms in mirror-image rotation about the pivot axis of the shoulder bolts 39. With particular reference to FIGS. 3–4, the pivotable movement of the journal arms 37 causes the larger lower end edges 43 of the wheels 33 and 34 to come into frictional engagement with the upper surface of the flap web portion 16 of the wrapper sheet immediately adjacent but slightly downstream of the point where the wheels touch the opposed lateral sides of the zipper strip 17 and overlying adjacent opposed lateral sides of the channel recess 24. Thus, the guide wheel device 31 serves to support the wheels 33 and 34 for rotation about axes tilted or skewed inward toward the intermediate zipper strip 17 passing therebetween and to bias the inner edges of the wheels 33 and 34 downwardly against the sheet wrapper on opposed sides of the zipper strip 17 over the channel recess 24, such that the wheels 33 and 34 rotate with movement of the wrapper sheet 13 across the first guide table surface 21, and at the same time, serve to maintain the zipper strip 17 by virtue of opposing forces aplied with the lower wheel edges 43 within the channel recess 24 to further maintain alignment of the sheet material 13 during movement over the feed platform 20.

The axes of rotation of the guide wheels 33 and 34 are further skewed in the direction of movement of the sheet material across the platform 21 (i.e., the downstream direction) such that the frictional engagement between the bottom circumferential edges of the guide wheels and the top surface of the wrapper sheet takes place at a point downstream from which the guide wheels begin to touch the zipper strip. This further skewing of the wheels 33 and 34 serves to ensure that as the sheet material moves through the guide wheel device 31, spreading forces are applied to the sheet material, keeping the material tight between the wheels and thus preventing a bunching up of material entering into the nip between the wheels 33 and 34.

Figure 5:
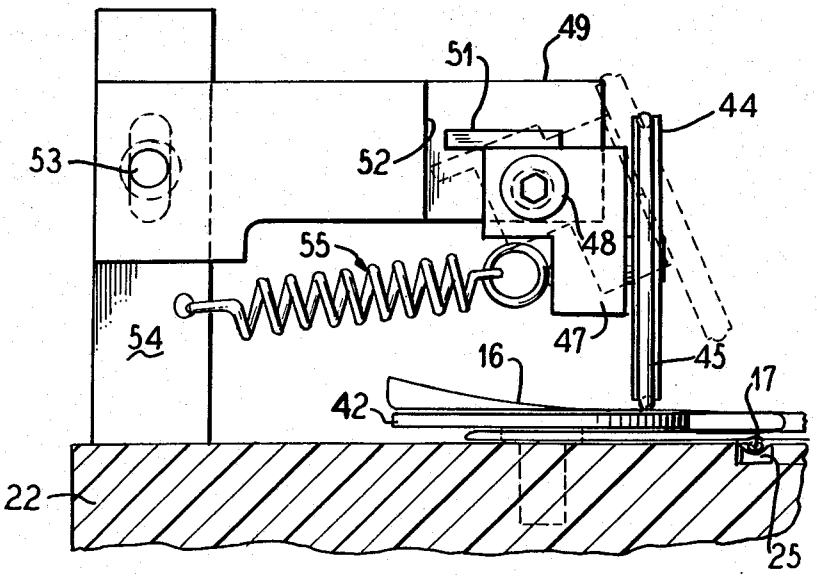
FIG. 5 is a fragmentary side elevational view of the flap or web portion unfolding guide wheel device of the feed conveyor arrangement of FIG. 1.

With reference to FIGS. 2 and 5–6, the flap turning wheel device 32 includes a platform wheel 42 disposed for rotation about a vertical axis on a stub shaft which is journaled for rotation in the top face of the second guide table 22. The wheel 42 is disposed for receiving thereover the pulled back upper surface of the web flap portion 16 of the sheet material 13 as shown in FIG. 2, such that the sheet wrapper 13 is suitably opened to clear the area of the panel portion 14 for reception of product. In order to cause the web flap portion 16 to be pulled back from the zipper strip line 17 and still permit the sheet material 13 to be passed longitudinally over the feed platform 20 of the feed conveyor arrangement 10, there is disposed for rotation on top of the platform wheel 42 a flap guide wheel 44, the circumference of which is provided with a friction ring 45, which may be made of rubber. The wheel 44 is disposed such that the friction ring 45 presses against the upturned inner surface of the web flap portion 16 as this flap portion is conveyed over the top surface of the platform wheel 42. The flap guide wheel 44 has a stub shaft 46 which is supported for rotation in a journal mount 47, such that the wheel 44 rotates about a lateral axis of rotation disposed at an acute angle relative to the longitudinal direction of movement of the sheet material 13 to the machine 12. The journal mount 47 is L-shaped and connected at its upper end by a shoulder bolt 48 connected to the recessed free end portion 49 of a support arm 50. The shoulder bolt 48 mounting enables the journal mount 47 and flap guide wheel 44 to be pivoted about a lateral axis defined by the shoulder bolt 48.

In order to thread the feed conveyor arrangement 10 with the sheet wrapper 13 for subsequent continuous operation, the journal mount 47 can be pivoted outward as shown by the phantom lines in FIG. 5 such that the lower end of the flat guide wheel 44 swings out away from the upper surface of the platform wheel 42 to permit the lead portion of the sheet material 13 to have its flap web portion 16 upturned so that when the flap guide wheel 44 is returned to engagement with the platform wheel 42 successive conduction of the sheet material 13 through the feed conveyor arrangement 10 will have the flap portion 16 cleared from the panel area 14 of the sheet material. The outward lift off pivoting movement of the journal mount 47 and flap guide wheel 44 is limited by a stop flange 51 disposed at the upper surface of the journal mount 47 which would abut with an opposed surface 52 of the recess portion 49 of the support arm 50, as shown by the phantom lines in FIG. 5.

It is important that a proper frictional force is applied to the upturned inner surface of the sheet flap web portion 16 such that the flap 16 is positively maintained turned away from the panel area 14 of the sheet material, while simultaneously permitting the sheet material 13 to be conducted longitudinally over the feed platform 20 into the machine 12. In this regard, the support arm 50 is vertically adjustably disposed by means of a releasable bolt connection 53 along an upstanding support bar 54 mounted by bracket means to the second guide table surface 22. Also, a spring connection 55 is provided between the lower end of the journal mount 47 and the support bar 54 for biasing the journal mount 47 and flap guide wheel 44 about the pivot axis of the shoulder bolt 48 to bring the friction ring surface 45 of the flap guide wheel 44 into proper frictional engagement with the web flap portion 16. By virtue of suitably positioning the support arm 50 along a support bar 54, the flap guide wheel can be disposed so as to be extending substantially perpendicular over the top surface of the platform wheel 42 and in lower end engagement to the intermediate flap surface with the platform wheel so as to afford a proper resultant frictional force RF.

As shown in FIG. 6, the resultant frictional force RF afforded by the disposition of the flap guide wheel on the platform wheel 42, is made up of an upwardly directed force component UF and a longitudinally directed force component LF. The force UF serves to maintain the inner surface of the flap web portion 16 upturned away from the panel area 14 of the sheet material so as to open up the sheet wrapper for reception of product. The longitudinal force component LF is aligned with the longitudinal movement of the sheet material 13 over the feed platform 20 so as to maintain the sheet material aligned such that the fastener strips 17 pass through the channel recesses 23 and 25 as the sheet material through the feed conveyor arrangement 10 to the machine 12.

The guide wheel device 31 and flap turning wheel device 32 together serve to provide a compact mechanical system for assuring longitudinally directed unwinding of wrapper sheet 13 from the roll 11 in an aligned manner through the feed conveyor arrangement 10 for delivery to the horizontal form, fill, and seal machine 12 and simultaneously turn back the overlying flap web portion 16 from the fastener strip profiles 17 so as to open up the panel area 14 of the wrapper material for proper reception of a product thereon and subsequent wrapping of the product in the sheet material. In regard to the latter function, the guide wheel device 31 provides a holddown or resistance force on the initially turned down flap portion 16 adjacent the zipper strip about which the flap is pivoted to its upturned position by virtue of the flap turning wheel device 32.

Although various minor modifications may be suggested by those versed in the art, it should be understood there are to be embodied within the scope of the patent warranted hereon all such modifications as reasonably and properly come within the scope of this contribution to the art.

We claim as our invention:

1. Apparatus for conducting a continuous elongate wrapper sheet to form, fill, and seal machine, wherein the wrapper sheet has a horizontal panel surface extending between upper and lower side edges, said lower side edge being free and said upper side edge being a web fold of sheet which partially horizontally overlaps the panel surface, and a reclosable zipper means in the form of a pair of cooperatively interlocked aligned strips extending horizontially of the wrapper sheet and respectively disposed on the facing upper surface of the panel surface and bottom surface of the overlapping web fold of sheet, said apparatus comprising:

means for conducting said wrapper sheet horizontally over a platform between a wrapper sheet supply and said form, fill, and seal machine, means for holding down said wrapper sheet during movement over said platform comprising a pair of rotatable guide wheels respectively disposed on opposed lateral sides of said zipper means and having lower circumferential edges engaging the top surface of the overlapping web fold of said wrapper sheet adjacent opposed sides of said zipper means wherein said rotatable guide wheels are supported for rotation in corresponding journal arms about rotational axes skewed toward each other above said wrapper sheet, said journal arms disposed for rotating movement about longitudinally directed pivot shafts, and further comprising means for resiliently biasing said journal arms about said pivot shafts to press said wheel edges against said web fold and panel surface thereby holding said zipper means against said platforms, and means on said platform for positively turning up a flap portion of said web fold of sheet above said zipper means downstream of said means for holding down.

2. The apparatus of claim 1, wherein the circumferential edge of each said guide wheel is beveled whereby the larger circumference edge surface is lowermost on each guide wheel and only such larger circumference edge surfaces engage said wrapper sheet.

3. The apparatus of claim 1, further comprising longitudinally directed channel means in said platform for aligning for movement therealong bottom surfaces of said wrapper sheet aligned with said zipper means, said guide wheel lower circumferential edges engaging said wrapper sheet adjacent opposed lateral sides of said channel means.

4. The apparatus of claim 1, further comprising spring clip means disposed on said platform upstream of said guide wheels for engaging on said wrapper sheet adjacent said zipper means to maintain said zipper means interlocked.

5. Apparatus for conducting a continuous elongate wrapper sheet to form, fill, and seal machine, wherein the wrapper sheet has a horizontal panel surface extending between upper and lower side edges, said lower side edge being free and said upper side edge being a web fold of sheet which partially horizontally overlaps the panel surface, and a reclosable zipper means in the form of a pair of cooperatively interlocked aligned strips extending horizontally of the wrapper sheet and respectively disposed on the facing upper surface of the panel surface and bottom surface of the overlapping web fold of sheet, said apparatus comprising:

means for conducting said wrapper sheet horizontally over a platform between a wrapper sheet supply and said form, fill, and seal machine, means for holding down said wrapper sheet during movement over said platform by positively engaging the top surface of the overlapping web fold of sheet adjacent said zipper means against said platform, and means on said platform for positively turning up a flap portion of said web fold of sheet above said zipper means downstream of said means for holding down, said flap turning means comprising a wheel rotatable about an axis angled from the horizontal direction in which said wrapper sheet is conducted and engaged on the upturned bottom surface of said flap portion as said wrapper sheet is conducted over said platform and a platform wheel mounted for rotation in said platform about an axis perpendicular to the rotational axis of said flap turning wheel and underlying said flap turning wheel for engagement thereby through said wrapper sheet.

6. The apparatus of claim 5, wherein said platform and flap turning wheels are rotated via conduct of said wrapper sheet therebetween.

7. The apparatus of claim 5, wherein said flap turning wheel is supported for rotation in a journal mount which is disposed for pivoting movement about a pin means defining a pivot axis perpendicular of the rotational axis of said flap turning wheel and further comprising means for biasing said journal mount about said pin means to hold said flap turning wheel engaged on the upturned bottom surface of said flap portion.

8. The apparatus of claim 5, wherein said wrapper sheet supply is in the form of a roll disposed to be unwound.

9. The apparatus of claim 5, wherein said means for holding down comprises a pair of rotatable guide wheels respectively disposed on opposed lateral sides of said zipper means and having lower circumferential edges engaging said wrapper sheet adjacent opposed sides of said zipper means.

10. The apparatus of claim 10, wherein said rotatable guide wheels are supported for rotation in corresponding journal arms about rotational axes skewed toward each other above said wrapper sheet, said journal arms disposed for pivoting movement about longitudinally directed pivot shafts, and further comprising means for biasing said journal arms about said pivot shafts.

11. The apparatus of claim 10, wherein the circumferential edge of each said guide wheel is beveled whereby the larger circumference edge surface is lowermost on each guide wheel and only such larger circumference edge surfaces engage said wrapper sheet.

12. The apparatus of claim 9, further comprising longitudinally directed channel means in said platform for aligning for movement therealong bottom surfaces of said wrapper sheet aligned with said zipper means, said guide wheel lower circumferential edges engaging said wrapper sheet adjacent opposed lateral sides of said channel means.

* * * * *